US006220989B1

(12) United States Patent
Wang

(10) Patent No.: US 6,220,989 B1
(45) Date of Patent: Apr. 24, 2001

(54) JOGGING EXERCISER

(76) Inventor: Wei-Chen Wang, 3F., No 30, Lane 151, Jen Ai Rd., Sec. 4, Taipei (TW)

( * ) Notice: Subject to any disclaimer, the term of this patent is extended or adjusted under 35 U.S.C. 154(b) by 0 days.

(21) Appl. No.: 09/085,999

(22) Filed: May 27, 1998

(51) Int. Cl.[7] ..... A63B 22/04
(52) U.S. Cl. ..... 482/51; 482/57
(58) Field of Search ..... 482/51, 52, 57, 482/70, 79, 80, 62

(56) References Cited

U.S. PATENT DOCUMENTS 5,879,271 * 3/1999 Stearns et al. ..... 482/51
6,063,008 * 5/2000 Mcbride et al. ..... 482/57
6,077,198 * 5/2000 Eschenbach ..... 482/51

* cited by examiner

*Primary Examiner*—Stephen R. Crow
(74) *Attorney, Agent, or Firm*—Pro-Techtor International Services

(57) ABSTRACT

A jogging exerciser includes two a base having an upright, two handles connected to two friction wheels at opposite sides on the upright, a locating pin for fixing the handles to the upright to stop the handles from turning with the friction wheels, a crank revolvably supported on the upright, a driving wheel turned with the crank, a flywheel coupled to the driving wheel, and two parallel sliding bars slidably supported on a rack at the rear side of the base and having pivoted to both ends of the crank.

1 Claim, 3 Drawing Sheets

JOGGING EXERCISER

BACKGROUND OF THE INVENTION

The present invention relates to a jogging exerciser, and more particularly to such a jogging exerciser which enables the user to simulate the exercises of jogging, bicycle riding and skiing.

A variety of exercising machines have been developed for exercising the muscles of the legs, and have appeared on the market. These exercising machines include step exercisers, climbing exercisers, stationary bicycles, etc. However, these exercising apparatus are designed to simulate only one particular exercising action.

SUMMARY OF THE INVENTION

The present invention has been accomplished to provide a jogging exerciser which enables the user to simulate the exercises of jogging, bicycle riding and skiing. According to one embodiment of the present invention, the jogging exerciser comprises a base having an upright, two handles connected to two friction wheels at opposite sides on the upright, a locating pin for fixing the handles to the upright to stop the handles from turning with the friction wheels, a crank revolvably supported on the upright, a driving wheel turned with the crank, a flywheel coupled to the driving wheel, and two parallel sliding bars slidably supported on a rack at the rear side of the base and having pivoted to both ends of the crank. Because the sliding bars are slidably supported on the rollers of the roller holders with respective front ends pivoted to the crank, the sliding bars are alternatively turned with the cranks and moved back and force when the user steps on the foot plate with the legs alternatively.

DETAILED DESCRIPTION OF THE PREFERRED EMBODIMENT

Figure 1:
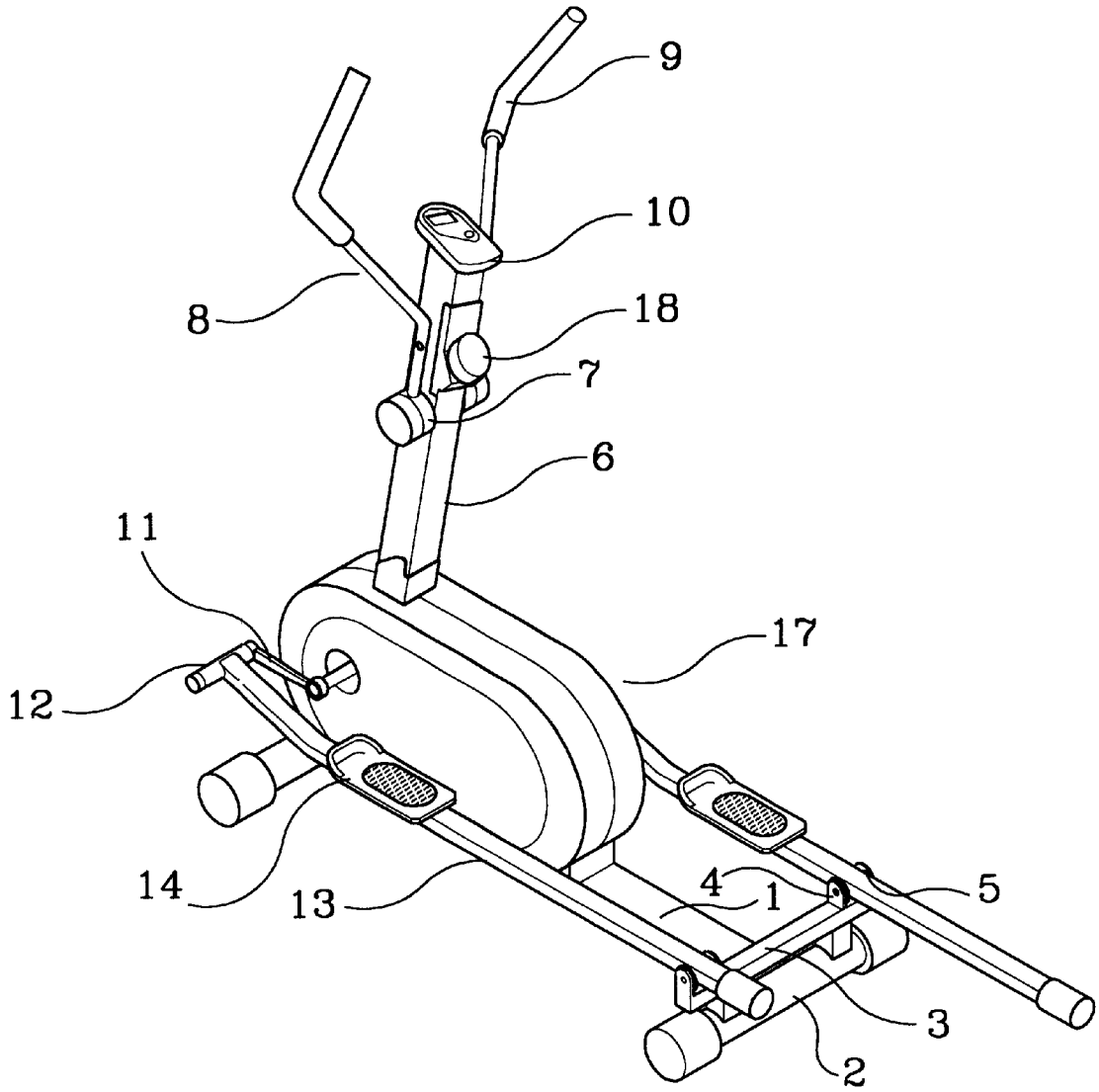
FIG. 1 is a perspective view of a jogging exerciser according to the present invention.
Figure 2:
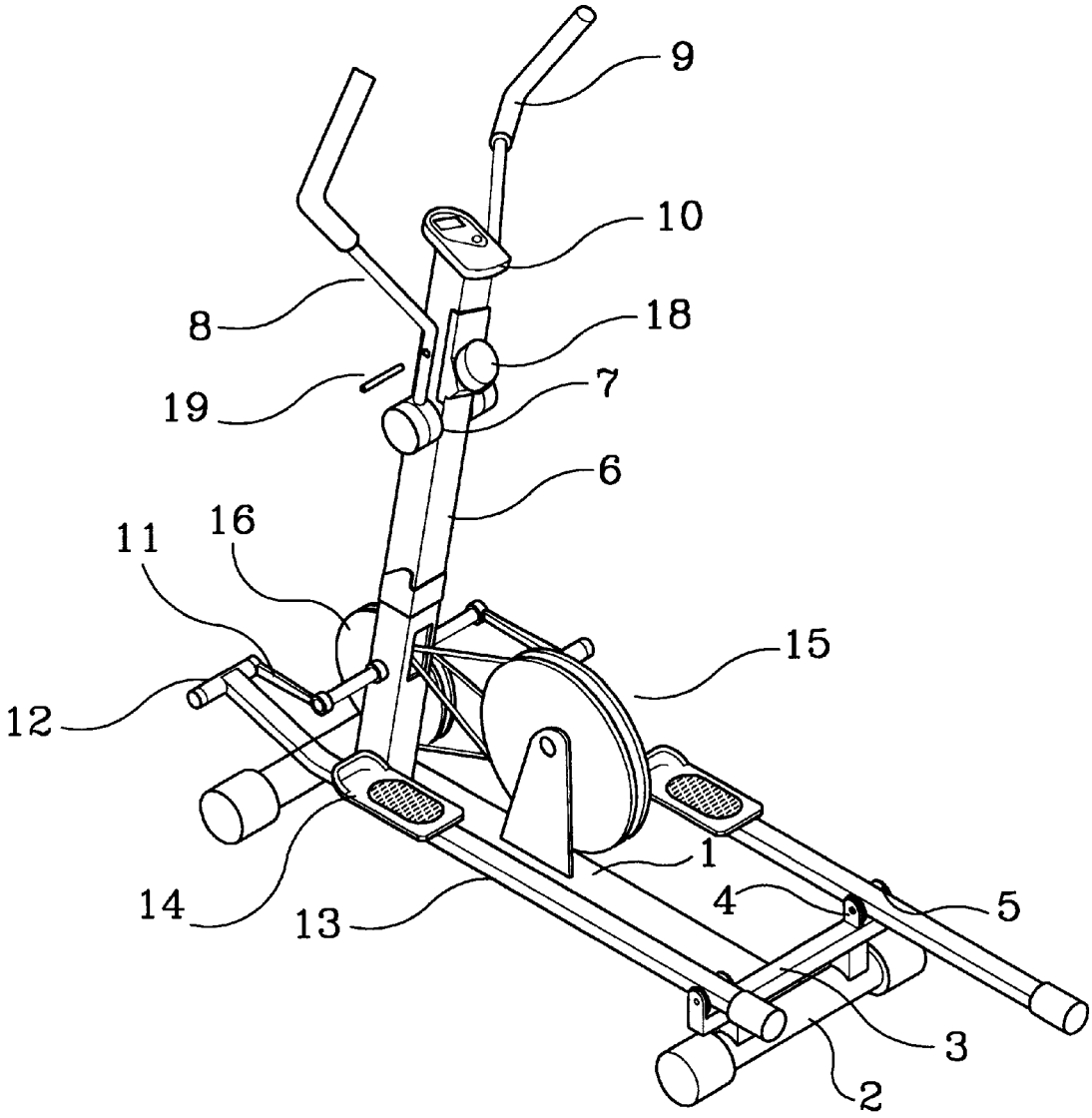
FIG. 2 is similar to FIG. 1 but showing the protective cover removed, the locating pin disconnected from the handles and the upright.

Referring to FIGS. 1 and 2, a jogging exerciser in accordance with the present invention comprises an I-base, which is comprised of two transverse bars 2 and a longitudinal bar 1 connected between the transverse bars 2. An upright 6 is raised from the front end of the longitudinal bar 1. A counter 10 is mounted on the upright 6 at the top. Two friction wheels 7 are bilaterally mounted on the upright 6 at a suitable elevation. Two handles 8 are respectively fastened to the friction wheels 7, each having a top end terminating in a hand grip 9. A locating pin 19 is provided for inserting into a respective pin hole on the handles and a through hole on the upright 6 to fix the handles 8 to the upright 6, and to stop the handles 8 from movement relative to the upright 6. A rack 3 is mounted on one transverse bar 2 remote from the upright 6. Two roller holders 4 are bilaterally provided at the rack 3. The roller holders 4 each hold a roller 5. Two sliding bars 13 are respectively supported on the rollers 5. Each sliding bar 13 has a front end mounted with a transverse barrel 12. A crank 11 is revolvably supported on a bearing in a transverse hole on the upright 6, having two opposite ends respectively coupled to the transverse barrels 12 at the front ends of the sliding bars 13. A driving wheel 16 is fixedly mounted around the crank 11 at one side of the upright 6. Two foot plates 14 are respectively mounted on the sliding bars 13 adjacent to the transverse barrels 12. A flywheel 15 is revolvably supported on the longitudinal bar 1 and coupled to the driving wheel 15 by a transmission belt. An adjustment knob 18 is provided at the upright 6 for adjusting the damping force of a friction belt to the driving wheel 16. Furthermore, a protective cover 17 is fastened to the upright 6 and the longitudinal bar 1 and covered around the driving wheel 16 and the flywheel 15.

Figure 3:
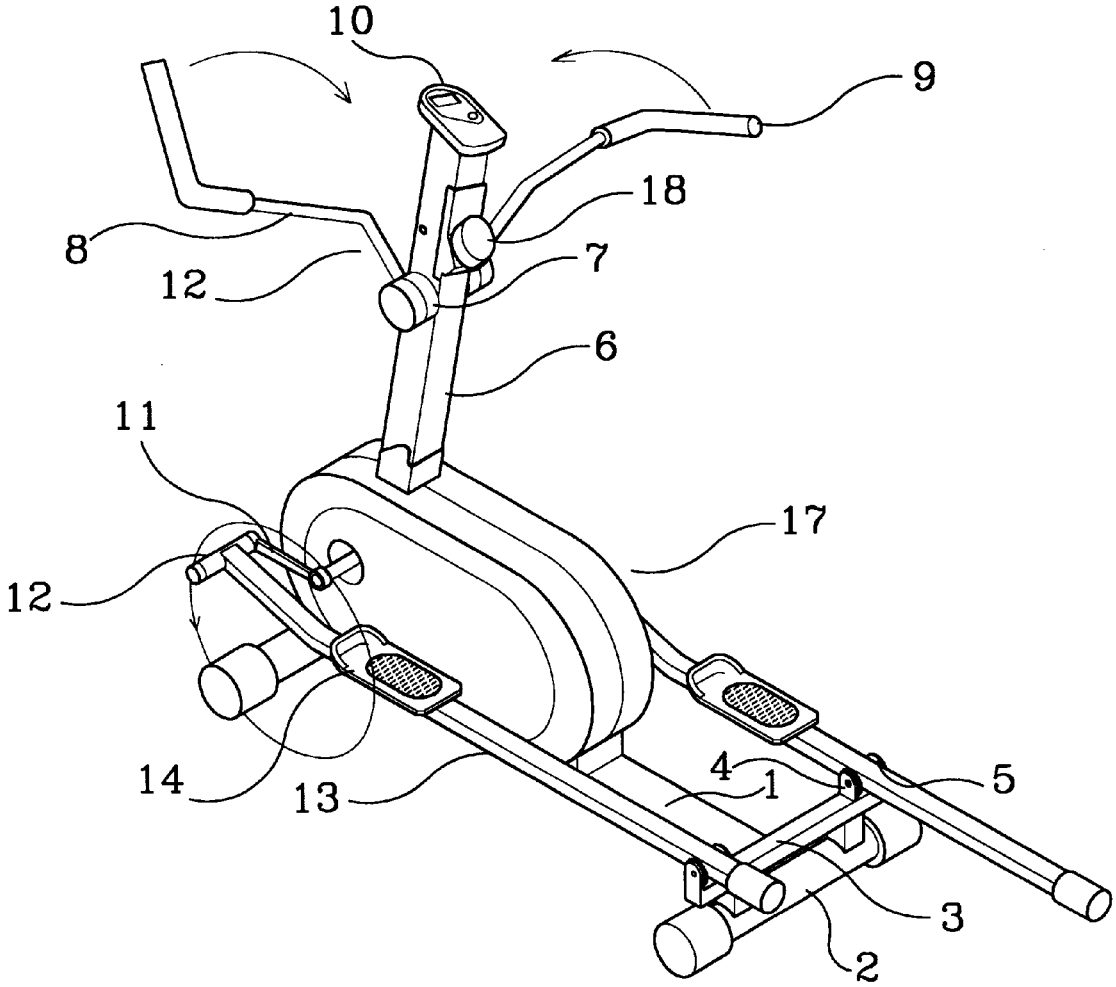
FIG. 3 shows the jogging exerciser operated.

Referring to FIG. 3, when the locating pins 19 are removed from the handles 8 and the upright 6, the handles 8 can then be alternatively turned with the hands. When turning the handles 8 with the hands, the foot plates 14 are alternatively moved back and forth and turned with the legs.

While only one embodiment of the present invention has been shown and described, it will be understood that the drawings are designed for purposes of illustration only, and are not intended as a definition of the limits and scope of the invention disclosed.

What the invention claimed is:

1. A jogging exerciser comprising:

a base, said base comprising a front transverse bar, a rear transverse bar and a longitudinal bar connected between said front transverse bar and said rear transverse bar;

an upright raised from said longitudinal bar adjacent to said front transverse bar;

a counter mounted on said upright at a top side;

two friction wheels bilaterally mounted on said upright;

two handles respectively fastened to said friction wheels, said handles each having a top end terminating in a hand grip;

two locating pins for inserting into a respective pin hole on said handles and a through hole on said upright to stop said handles from turning with said friction wheels;

a rack mounted on said rear transverse bar;

two roller holders bilaterally mounted on said rack, said roller holders each holding a roller;

two sliding bars respectively supported on the rollers of said roller holders, said sliding bars each having a front end mounted with a transverse barrel;

a crank revolvably supported on said upright, said crank having two opposite ends respectively coupled to the transverse barrels at the front ends of said sliding bars;

a driving wheel fixedly mounted around said crank at one side of said upright and rotated with said crank;

two foot plates respectively mounted on said sliding bars near the front ends of said sliding bars;

a flywheel revolvably supported on said longitudinal bar and coupled to said driving wheel by a transmission belt; and an adjustment knob mounted on said upright for adjusting the damping force of a friction belt to said driving wheel.

* * * * *